United States Patent [19]

Luxa

[11] 4,351,989

[45] Sep. 28, 1982

[54] DISCONNECT SWITCH FOR METAL-ENCAPSULATED HIGH-VOLTAGE SWITCHING INSTALLATIONS

[75] Inventor: Günther Luxa, Berlin, Fed. Rep. of Germany

[73] Assignee: Siemens Aktiengesellschaft, Munich, Fed. Rep. of Germany

[21] Appl. No.: 871,943

[22] Filed: Jan. 24, 1978

[30] Foreign Application Priority Data

Jan. 31, 1977 [DE] Fed. Rep. of Germany ..... 2704385

[51] Int. Cl.[3] ..... H01H 31/00

[52] U.S. Cl. ..... 200/48 CB; 200/304

[58] Field of Search ..... 200/239, 48 CB, 144 R, 200/149 B, 153 S, 304, 305, 144 C

[56] References Cited

U.S. PATENT DOCUMENTS 2,293,701 8/1942 Delmonte ..... 200/144 R 3,720,798 3/1973 Kabayama et al. ..... 200/304

3,818,165 6/1974 Zavitsanos et al. ..... 200/144 C

*Primary Examiner*—Willis Little

*Attorney, Agent, or Firm*—Kenyon & Kenyon

[57] ABSTRACT

A disconnect switch for use in a metal-encapsulated high-voltage switching installation, wherein the switch includes a movable switching pin, a mating contact axially associated therewith, and a cylindrical member arranged in surrounding spaced relationship to the mating contact. The cylindrical member is further formed so as to extend beyond that end face of the mating contact which is in facing relationship with the switching pin, whereby the member projects into the gap between the switching pin and the mating contact when the disconnect switch is in the "off" position and surrounds the switching pin when the switch is in the "on" position.

4 Claims, 1 Drawing Figure

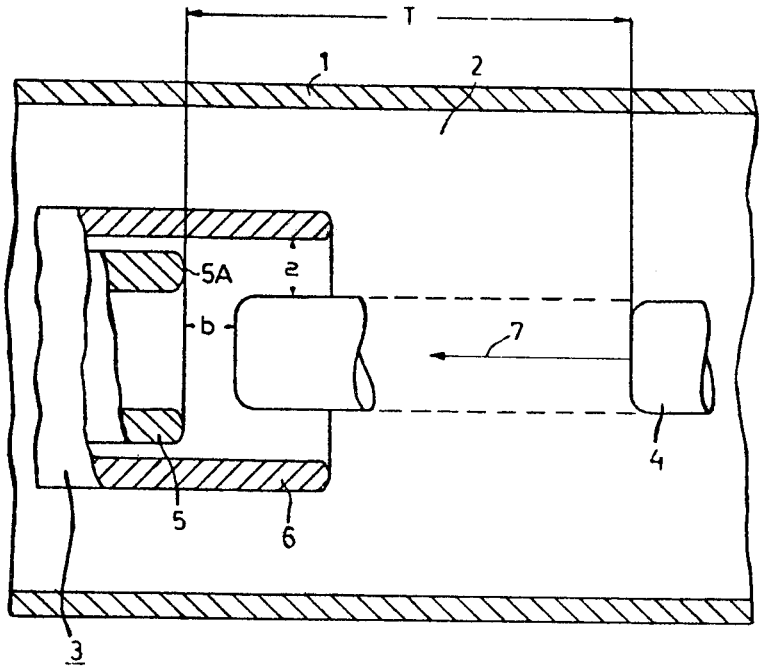
T
1
2
5A
a
b
7
4
5
6
3

DISCONNECT SWITCH FOR METAL-ENCAPSULATED HIGH-VOLTAGE SWITCHING INSTALLATIONS

BACKGROUND OF THE INVENTION

1. Field of the Invention

This invention relates to a disconnect switch for use with a metal encapsulated high voltage switching installation wherein the switch includes a movable switching pin and a mating contact axially associated therewith.

2. Description of the Prior Art

In known disconnect switches of the above type, the movable switching pin is actuated by a motor drive, which requires from between 5 to 10 seconds to close the switch. The actual closing time depends on the size of the gap between the switching pin and the mating contact which, in turn, is a function of the nominal voltage.

If a disconnect switch of the present type is closed, a preliminary breakdown with a subsequent low-current arc always occurs, if the disconnect switch is operated under voltage. In such case, the burning time of the preliminary arc takes several seconds.

For disconnect switches which are suitable for voltages of up to 123 kV, the preliminary breakdown distance is so small, particularly where sulfur hexafluoride is used as the quenching and insulating medium of the metal-encapsulated installation, that the arc does not wander off while it burns. In disconnect switches for voltages higher than 123 kV and for currents of about 2000 A, the preliminary breakdown distance is larger, so that there is a definite danger that the preliminary arc will wander from the point of its origin to the grounded encapsulation of the installation.

It is, therefore, an object of the present invention to provide a disconnect switch of the above type which can be used for voltages above 245 kV and whose longer-burning arc is prevented from wandering.

SUMMARY OF THE INVENTION

In accordance with the principles of the present invention, the above and other objectives are realized in a disconnect switch of the above type by further including therein a cylindrical member arranged in surrounding spaced relationship to the mating contact. More particularly, the cylindrical member is formed so as to extend beyond that end face of the mating contact which is in facing relationship with the switching pin, whereby the cylindrical member projects into the gap between the switching pin and mating contact in the "off" position of the switch and surrounds the switching pin in the "on" position of the switch.

With the disconnect switch so formed, the cylindrical member acts as an arc cage which prevents the switching-on arc from spreading or wandering. Advantageously, the cylindrical member can be designed as a component which equalizes the electric field and is rigidly connected to the mating contact. The member may be formed of a metal with electrically conducting properties, or may also be formed of an insulating material. It is further advantageous to select the spacing between the cylindrical member and the switching pin so that it is larger than the preliminary breakdown distance between the switching pin and the mating contact. This ensures that a preliminary breakdown takes place only between the switching pin and the mating contact.

BRIEF DESCRIPTION OF THE DRAWING

The above and other features and aspects of the present invention will become more apparent upon reading the following detailed description in conjunction with the accompanying drawings in which the sole figure thereof illustrates in longitudinal cross section a disconnect switch in accordance with the principles of the present invention.

DETAILED DESCRIPTION

The drawing shows schematically in a longitudinal cross section a disconnect switch 3 in accordance with the principles of the present invention. As shown, the switch is disposed within a metal-encapsulated high-voltage switching installation which includes a tubular encapsulation 1 in whose interior 2 is a gaseous insulating medium, such as, for example, sulfur hexafluoride, at a pressure of, for instance, 5 bar.

The switch 3 includes a movable switching pin 4 which cooperates with an axially associated mating contact 5. The mating contact 5, in turn, is surrounded in spaced relationship by a cylindrical member 6 which extends beyond the end face 5A of the contact 5. The member 6 thus projects into the gap T between the contact 5 and pin 4 when the switch 3 is in the "off" position. As can be seen, the cylindrical member 6 is also formed so as to equalize the electric field between the switching pin 4 and the mating contact 5 and is situated so as to be rigidly connected to such contact.

As shown, the cylindrical member 6 is formed of an electrically conducting metal, but the member can also be formed of an insulating material. Advantageously, the radial spacing a between the switching pin 4 and the cylindrical member 6 is selected to be larger than the preliminary breakdown axial distance b between the switching pin 4 and the mating contact 5.

In operation, the switching pin 4 is moved by the motor drive of the switch 3 (the motor drive has not been specifically illustrated to avoid complicating the drawing) in the direction of the arrow 7 to transfer the switch into the "on" position. Due to the selection of the distance a as above-described, no breakdown occurs between the switching pin 4 and the cylindrical member 6 during movement through the gap T. Instead, breakdown occurs only between the movable switching pin 4 and the mating contact 5 via the gap b. It is thereby ensured that the cylindrical member 6 acts as a cage for the arc, whereby the arc is prevented from wandering off in such a manner that one of its bases starts at the grounded encapsulation 1.

What is claimed is:

1. In a disconnect switch for use in a metal-encapsulated high-voltage switching installation at voltages of 245 kV and above which includes a tubular grounded encapsulation containing a gaseous insulating medium, said switch including a movable switching pin and a mating contact axially associated therewith, said movable switching pin being adapted for axial movement toward and engagement with said mating contact when said switch is moved from an "off" to an "on" position, the improvement comprising a cylindrical member arranged in spaced surrounding relationship to said mating contact and formed so as to extend beyond that end face of said mating contact which is in facing relationship with said switching pin, said cylindrical member projecting beyond the end face of said mating contact and terminating in the gap between said mating contact and said switching pin when said switch is in said "off" position, said cylindrical member also projecting beyond the end face of said switching pin and surrounding said switching pin when said switch is in said "on" position, said cylindrical member being radially spaced apart from the surface of said switching pin by a distance which is greater than a preliminary breakdown axial distance between said mating contact and said switching pin at which breakdown between said mating contact and switching pin occurs as said switching pin moves towards said mating contact as said switch is moved to said "on" position, so that when said switch is moved to said "on" position, a preliminary breakdown takes place during movement of said movable switching pin to said "on" position of said switch only between said switching pin and said mating contact and not between said switching pin and said cylindrical member.

2. In a disconnect switch in accordance with claim 1, the improvement wherein:

said cylindrical member is formed so as to equalize the electric field between said mating contact and said switching pin and is rigidly connected to said mating contact.

3. In a disconnect switch in accordance with claim 1, the improvement wherein:

said cylindrical member comprises an electrically conducting metal.

4. In a disconnect switch in accordance with claim 1, the improvement wherein:

said cylindrical member comprises an insulating material.

* * * * *